US006578269B2

(12) United States Patent
Wilcox et al.

(10) Patent No.: US 6,578,269 B2
(45) Date of Patent: Jun. 17, 2003

(54) MOVABLE COMB ADVANCING SYSTEM FOR HAIR TRIMMERS

(75) Inventors: John Wilcox, Newport, RI (US); Peter G. Katz, Fairfield, CT (US)

(73) Assignee: Remington Corporation, L.L.C., Bridgeport, CT (US)

( * ) Notice: Subject to any disclaimer, the term of this patent is extended or adjusted under 35 U.S.C. 154(b) by 0 days.

(21) Appl. No.: 10/007,901

(22) Filed: Nov. 9, 2001

(65) Prior Publication Data

US 2002/0095793 A1 Jul. 25, 2002

Related U.S. Application Data

(60) Provisional application No. 60/256,768, filed on Dec. 19, 2000.

(51) Int. Cl.[7] ..... B26B 19/20
(52) U.S. Cl. ..... 30/201; 30/233
(58) Field of Search ..... 30/200, 201, 233, 30/202, 233.5

(56) References Cited

U.S. PATENT DOCUMENTS 2,731,720 A * 1/1956 Henard ..... 30/201
3,387,367 A * 6/1968 Merzon ..... 30/201
4,776,095 A * 10/1988 Tsujimoto et al. ..... 30/201
5,084,974 A * 2/1992 Sukow et al. ..... 30/201
5,979,060 A * 11/1999 Holzbauer et al. ..... 30/201

* cited by examiner

*Primary Examiner*—Hwei-Siu Payer
(74) *Attorney, Agent, or Firm*—Melvin I. Stoltz

(57) ABSTRACT

By providing a rotatable wheel mounted in cooperating engagement with a longitudinally movable arm or slide member, an easily employed, dependable, and reliable movable comb control system is achieved, enabling users to controllably move the comb member on a hair trimmer any desired distance. In the present invention, cam slots are formed in the wheel with the slots positioned for controlled engagement with cam pins formed on the movable arm or slider. By employing this construction, rotational movement of the wheel causes controlled movement of the cam pins which results in the desired longitudinal movement of the arm/slider. By securing the elongated arm/slider to the comb element, either directly or through an interconnecting plate, the longitudinal movement of the arm/slider causes the comb element to move simultaneously therewith.

20 Claims, 8 Drawing Sheets

MOVABLE COMB ADVANCING SYSTEM FOR HAIR TRIMMERS

RELATED APPLICATIONS

This application is related to U.S. Provisional Patent Application Serial No. 60/256,768, filed Dec. 19, 2000 entitled MOVABLE COMB ADVANCING SYSTEM FOR HAIR TRIMMERS.

TECHNICAL FIELD

This invention relates to beard and mustache trimmers and, more particularly, to control systems for moving a comb element relative to the cutting blade.

BACKGROUND ART

During the last many years, individuals have been increasingly drawn to the advantages provided by electric shaver's and electric hair trimmers. In general, the consuming public has found that the use of scissors, razors, and other cutting systems are extremely inconvenient for removing, trimming, or maintaining beards, mustaches, and hair lengths. In particular, cutting or trimming children's hair is often difficult with prior art methods. In addition, with the ever-increasing time constraints and commitments individuals typically encounter, a fast and effective trimming or cutting system is most desirable.

Through the years, numerous alternate constructions have been created for hair trimmers, particularly suited for beards and mustaches and hair. Most of these prior art systems employ similar cutting systems in combination with a movable comb element which is positioned in overlying, co-operating relationship with the cutting blades. Typically, one fixed blade and one movable blade cooperate to perform the hair or whisker cutting function, while the comb element establishes a fixed length from the skin surface at which the hair fibers will be cut.

In order to provide a hair trimmer which is capable of being used in a wide variety of alternate hair cutting situations, the comb element associated with the hair trimmer is movably adjustable relative to the cutting blades, in order to allow the user to control the length at which the hair fibers are cut. Unfortunately, prior art constructions have been incapable of providing an adjustable comb element which is easy to employ, while also assuring secure locked engagement of the comb element in any desired position.

Typically, in these prior art constructions, the comb element is either extremely difficult to move or to adjust between its alternate positions. Alternatively, in those prior art systems where movement of the comb element is capable of being achieved with reasonable ease or convenience, the comb element is not securely retained in any desired position. Instead, the comb element easily returns to its original position, whenever any pressure is applied to the comb element.

This unwanted movement of the comb element is extremely difficult for the user to endure, since the user is attempting to cut the beard, mustache, or hair fibers to a specific length. In this regard, whenever the position of the comb element moves during use, the hair fibers are cut to a substantially different length and the desired uniformity or consistency is lost.

SUMMARY OF THE INVENTION

By employing the present invention, all of the difficulties and drawbacks found in prior art hair trimmers are completely eliminated and a secure, easily employed, dependable, and reliable movable comb control system is achieved. In accordance with the present invention, a user controlled advancing system is provided which is constructed for controllably moving an elongated arm a preset distance each time this system is activated.

In the present invention, a rotatable wheel is mounted in cooperating engagement with a longitudinally movable arm or slide member. However, contrary to prior art constructions which employ a rack and pinion control system, the present invention incorporates cam slots formed in the wheel with the slots positioned for controlled engagement with cam pins formed on the movable arm or slider. By employing this construction, rotational movement of the wheel causes controlled movement of the cam pins which results in the desired longitudinal movement of the arm/slider. By securing the elongated arm/slider to the comb element, either directly or through an interconnecting plate, the longitudinal movement of the arm/slider causes the comb element to move simultaneously therewith.

By constructing the cam slots of the wheel member in a generally radial, arcuately curved pattern having a serpentine surface or wall, a plurality of separate and independent stop positions are established. In addition, the arm member is mounted in controlled cooperating relationship with the wheel member, sandwiched between an upper and lower housing.

As a result of this construction, the arm/slider is capable of longitudinal movement in a single plane, with the longitudinal movement being completely controlled by the sliding engagement of the cam pins of the arm/slider in the cam slot of the rotatable wheel. In this way, the desired easily employed, secure and dependable movement of the comb element attached to the arm member is achieved by simply rotating the wheel in a desired direction, causing the cam pins of the arm member to move between the stop positions formed along the cam slot of the wheel.

In the preferred construction of the present invention, the rotatable wheel member incorporates two separate and independent cam slots formed therein, with each cam slot being formed on opposed side surfaces of the wheel member. In addition, two separate and independent cam pins are formed on the arm member, with each cam pin being positioned for cooperating with one cam slot.

Furthermore, the entry zones or portals for each cam slot of the wheel member are formed at diametrically opposed positions. As a result, by properly positioning the cam pins on the arm/slider, the rotational movement of the wheel controls one cam pin at a time, with the first pin exiting one cam slot while the second pin enters the second cam slot. In this way, the total longitudinal travel distance of the arm/slider is maximized for the diameter of the wheel.

In addition to providing a plurality of positions for the movement of the arm/slider by the rotation of the wheel, the construction of the cam slots with its serpentine surface or wall also provides an inherent abutment stop for each position, preventing unwanted, sliding movement of the arm member relative to the cam slot independently of the user initiated rotation of the wheel. As a result, axial or longitudinal movement of the arm is incapable of occurring accidentally and the desired secure engagement of the comb element in each position is realized.

By rotationally moving the wheel member in a desired direction, the comb member is quickly and easily advanced into any desired position, while also assuring that the comb member is securely retained in any selected position.

Furthermore, as detailed above, once the comb member has been placed in a desired position, axial movement of the comb member due to conventional pressure being applied thereto is eliminated by the present invention. In this way, all of the goals and objects desired by the present invention are attained.

A further feature preferably incorporated into the comb control system of the present invention is the incorporation of positive-position stops or indicators. In the preferred construction, the wheel member incorporates a plurality of grooves formed in an outer wall portion thereof in substantially equal spaced intervals. In addition, a spring arm is mounted for biased engagement in each groove as the wheel is rotated.

By employing this construction, the rotation of the wheel member causes the spring member to move from one groove to the next providing a positive, audible click, while also providing a resistance to rotational movement which must be overcome to move the wheel and arm/slider into the next position. In addition, the wheel member also preferably incorporates a visual indicator such as a number, to further assist the user in recognizing each position.

The invention accordingly comprises the features of construction, combination of elements and arrangement of parts which will be exemplified in the construction hereinafter set forth, and the scope of the invention will be indicated in the claims.

THE DRAWINGS

For a fuller understanding of the nature and objects of the present invention, reference should be had to the following detailed description taken in connection with the accompanying the drawings, in which.

DETAILED DESCRIPTION

By referring to FIGS. 1–11, the construction and operation of the controlled advancing system of the present invention can best be understood. As detailed herein, the movement control system of the present invention is depicted and exemplified in operation in a hair trimmer and/or beard and mustache trimmer 20. However, the construction of the present invention may be implemented and employed in a wide variety of alternate products. Consequently, it is to be understood that the detailed disclosure provided herein is for exemplary purposes only and is not intended as a limitation of the present invention.

Figure 1:
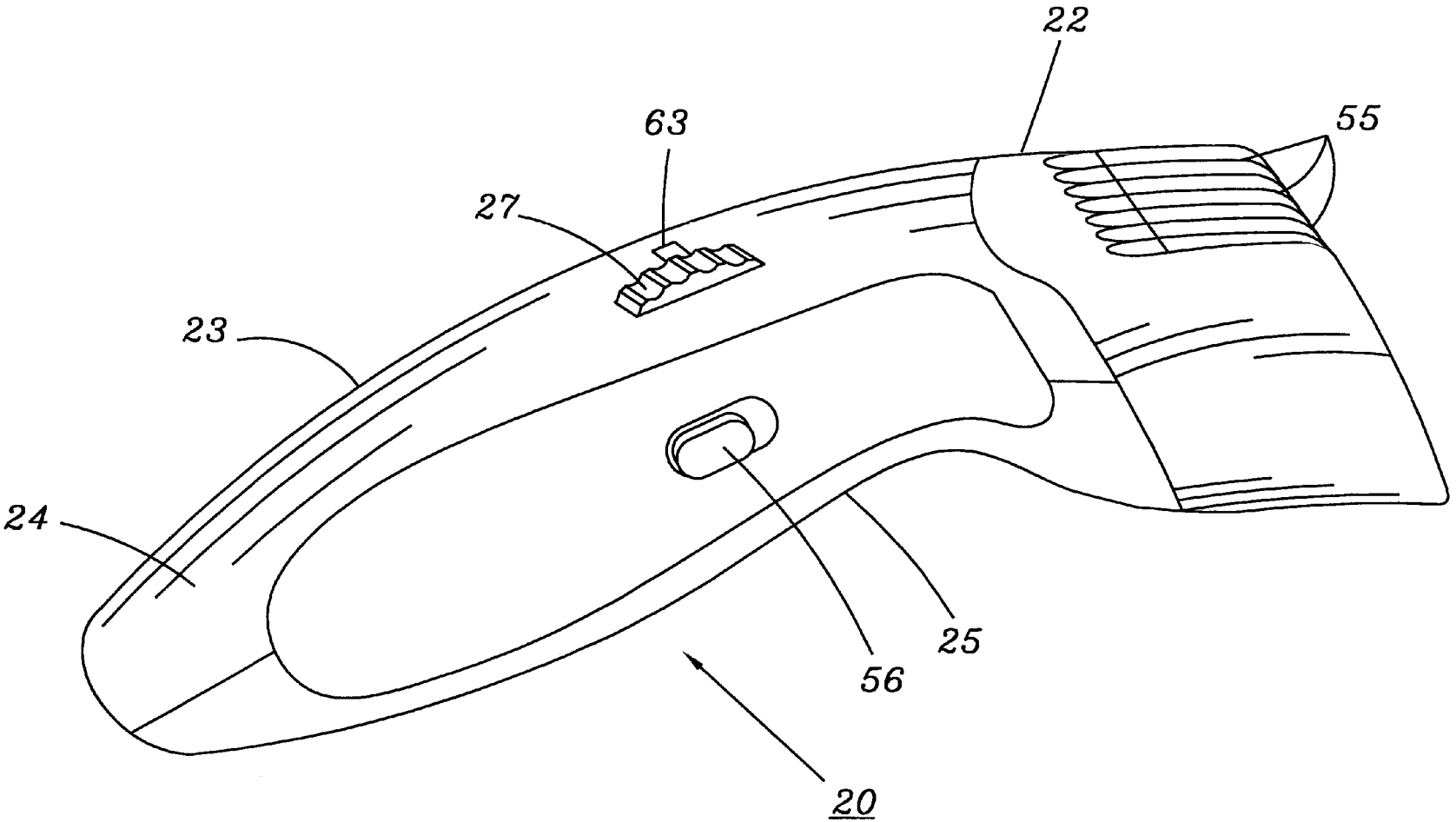
FIG. 1 is a perspective view of a beard and mustache trimmer incorporating the controlled advancing system of the present invention.
Figure 2:
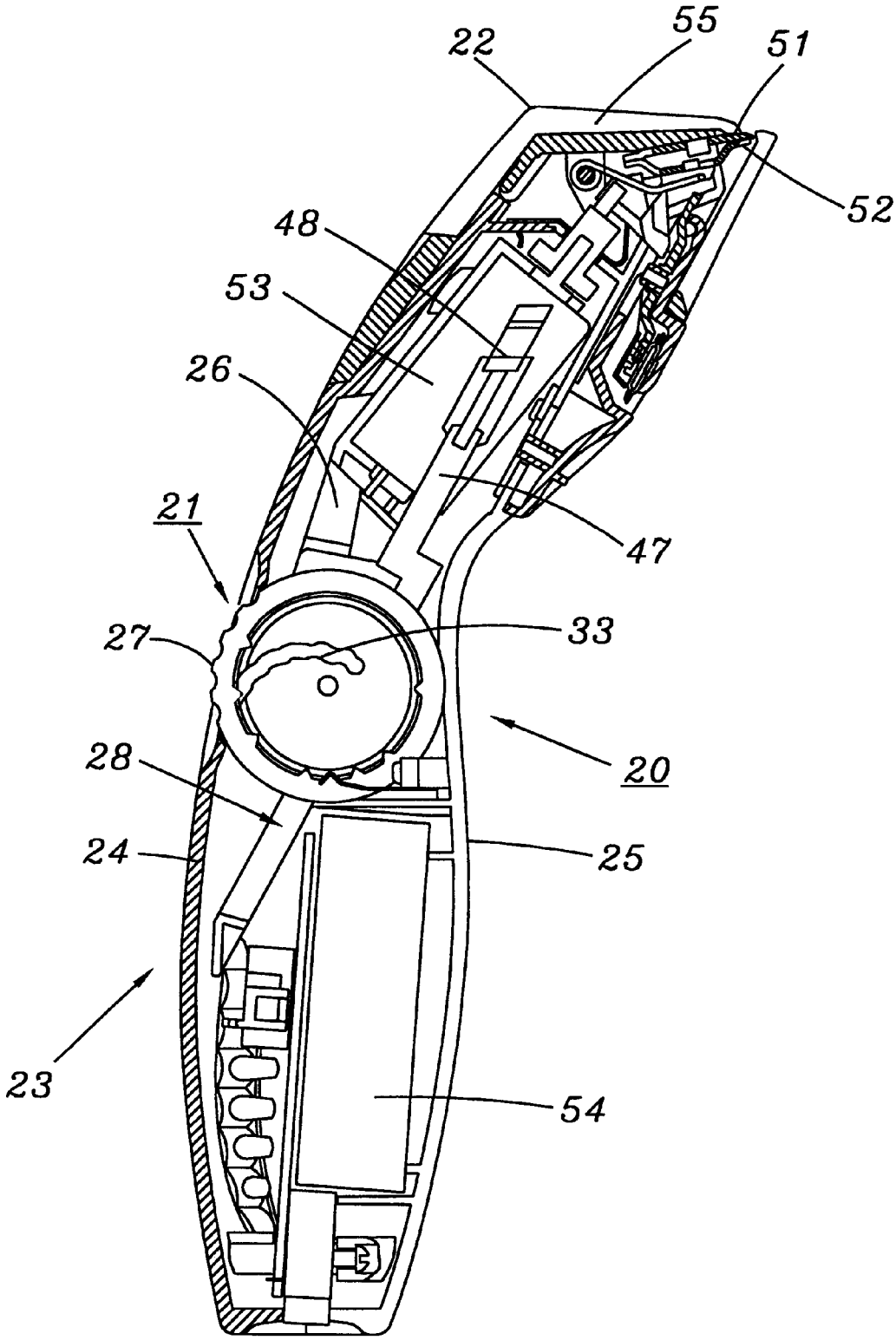
FIG. 2 is a cross-sectional side elevation view of the beard and mustache trimmer incorporating the controlled advancing system of the present invention.
Figure 3:
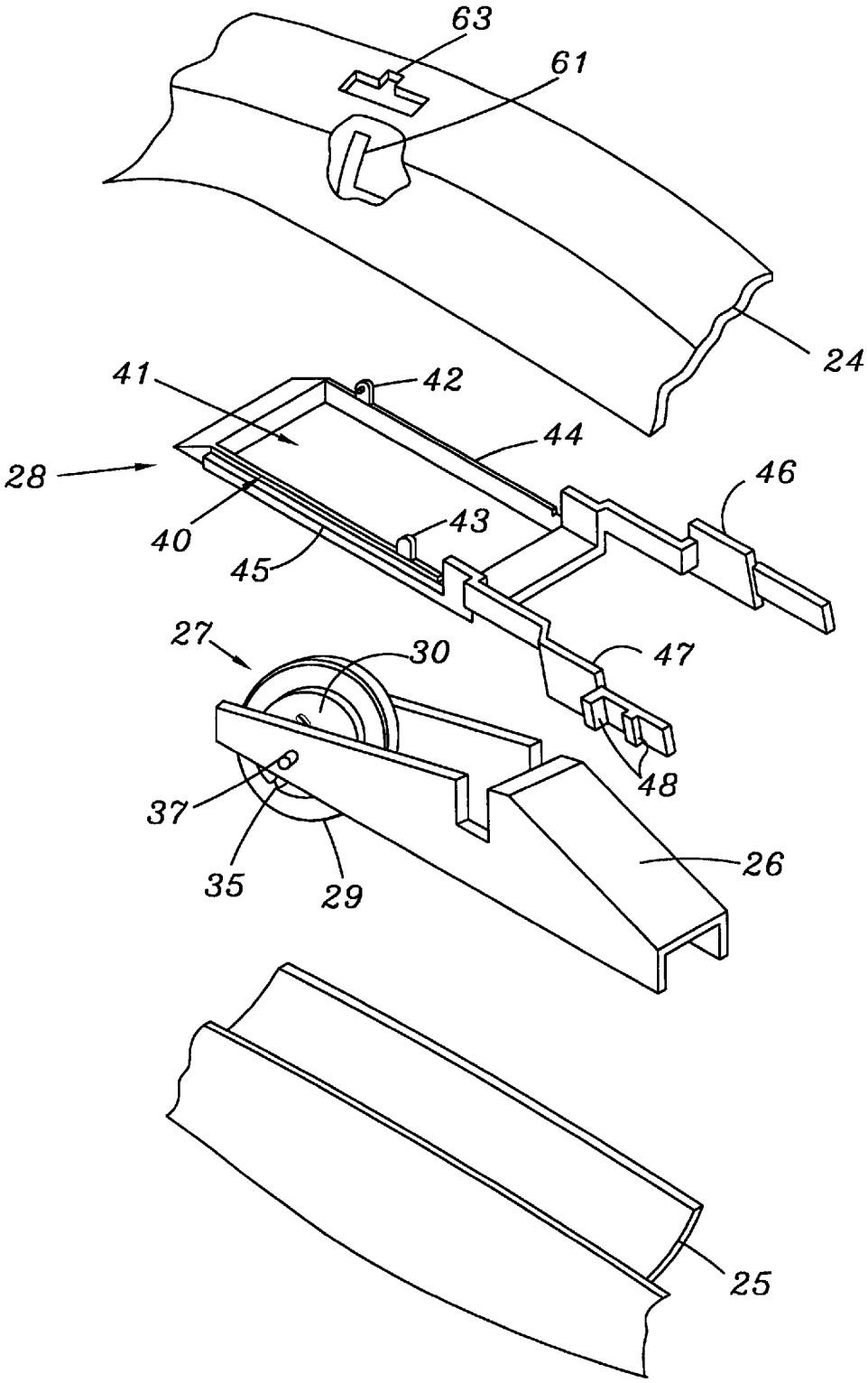
FIG. 3 is an exploded a perspective view, partially broken away, depicting the components of the controlled advancing system mounted in a beard and mustache trimmer.

In FIGS. 1–3, beard/mustache trimmer 20 is depicted incorporating controlled advancing system 21 of the present invention. As shown beard/mustache trimmer 20 comprises housing 23, formed by upper portion 24 and lower portion 25 and movable comb member 22.

Movably mounted within housing 23 is controlled advancing system 21. In this preferred embodiment, controlled advancing system 21 comprises rotatable wheel 27 and arm or slider 28. In the preferred embodiment, wheel 27 is mounted to support plate 26 for rotational movement relative thereto, while support plate 26 is securely mounted in housing 23 between upper portion 24 and lower portion 25. In addition, arm/slider 28 is mounted between upper portion 24 and lower portion 25, in sliding association with support plate 26 controllably engaged with wheel 27 and longitudinally movable relative to housing 23.

As typically found in prior art products of this nature, beard/mustache trimmer 20 incorporates a pair of cutting blades 51 and 52 mounted at one end of housing 23, with one of said blades constructed for side-to-side reciprocal motion. In this way, the desired cutting action is achieved. In order to provide the desired side-to-side movement, beard/mustache trimmer 20 also incorporates motor 53 which is connected to power source 54 for providing the requisite electrical energy for activating motor 53 and causing cutting blade 52 to reciprocally move relative to cutting blade 51. In addition, switch 56 is employed for activating and de-activating motor 53.

In order to enable the user to completely control the length of the hair being cut, comb member 22 is mounted to housing 23 in secure movement-controlling engagement with comb engaging ridges 48 of arm/slider 28. As shown in FIG. 1, comb member 22 incorporates a plurality of spaced fingers 55 formed thereon which are positioned for cooperating with cutting blades 51 and 52.

By axially advancing comb member 22 relative to cutting blades 51 and 52, the distance between finger members 55 of comb member 22 and cutting blades 51 and 52 is easily controlled. In this way, by increasing the distance between finger members 55 of comb member 22, the length of the hair fibers which are capable of being cut by blades 51 and 52 is also increased. In order to enable the user to obtain complete control over the precise spaced distance between finger members 55 of comb member 22 and cutting blades 51 and 52, controlled advancing system 21 is employed.

Figure 4:
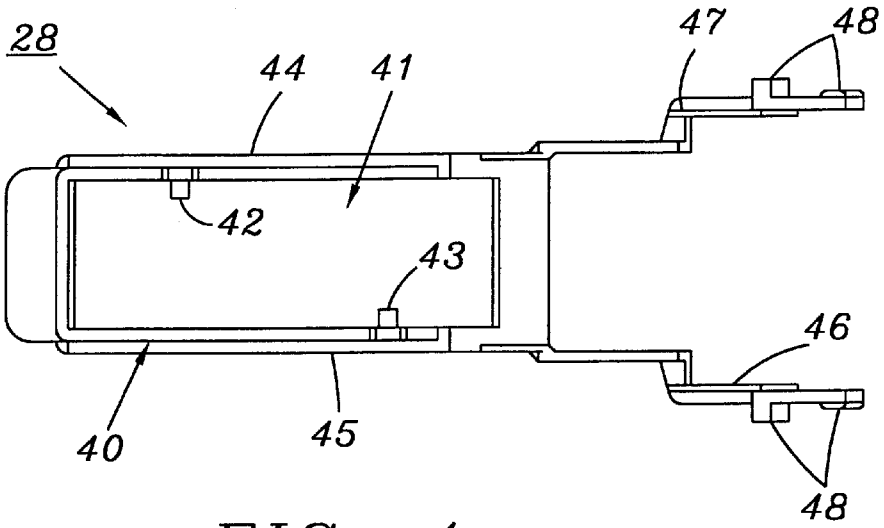
FIG. 4 is a top plan view of the arm/slider component of the controlled advancing system of the present invention.
Figure 5:
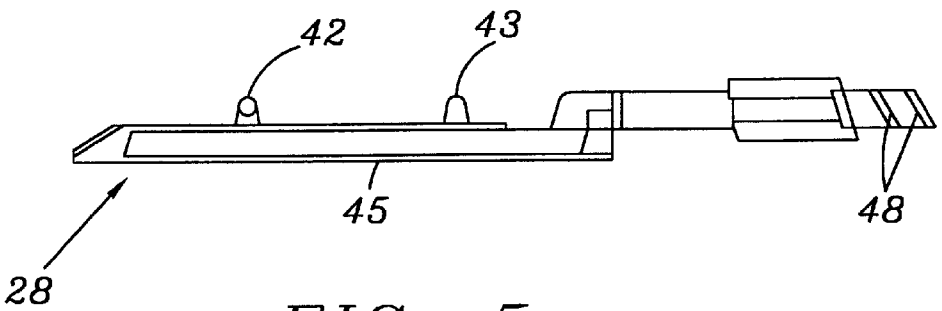
FIG. 5 is a side elevation view of the arm/slider component of FIG. 4.
Figure 6:
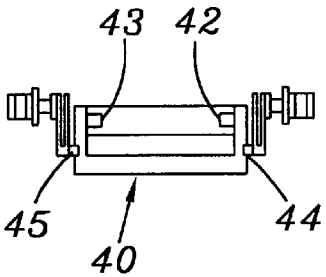
FIG. 6 is a front end view of the arm/slider components of FIG. 4.
Figure 10:
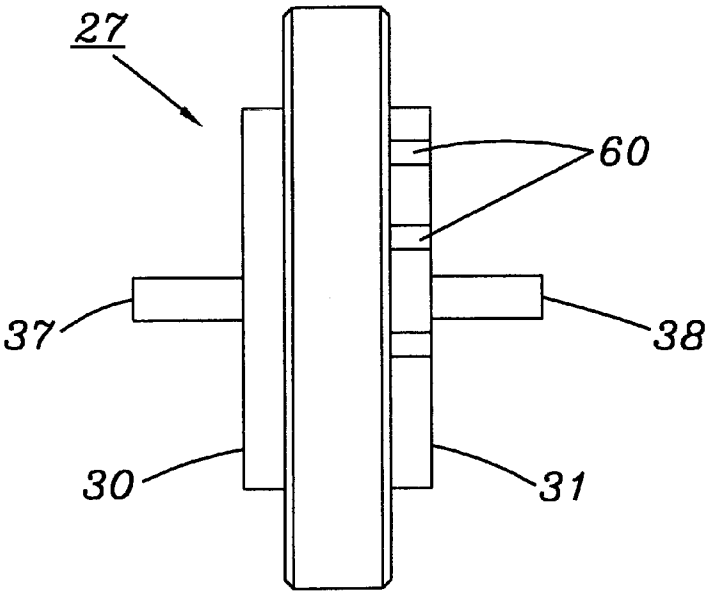
FIG. 10 is an end view of the rotatable wheel components of FIG. 7.
Figure 7:
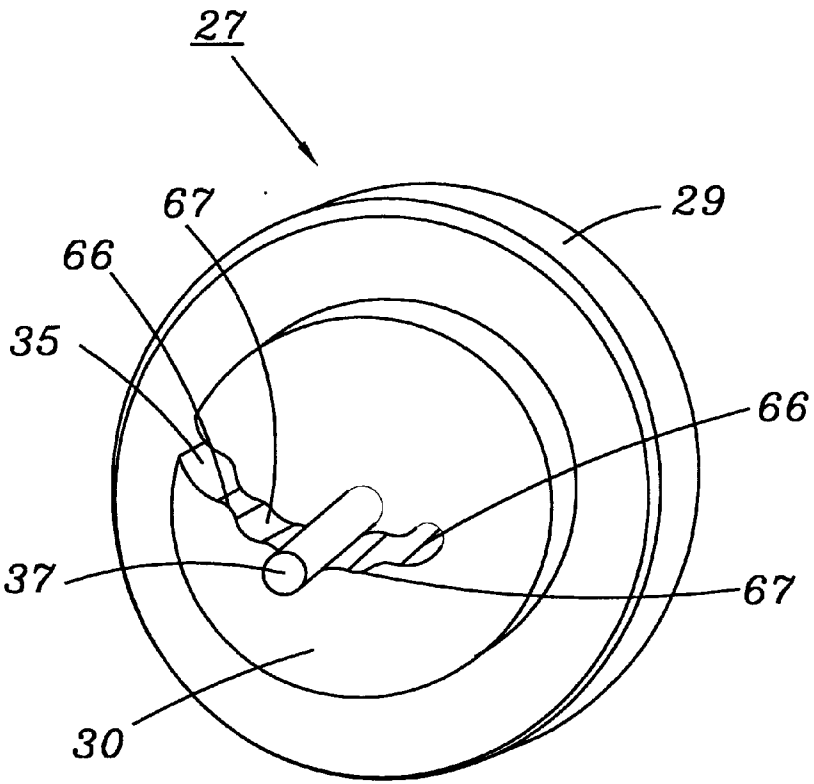
FIG. 7 is a perspective view of the rotatable control wheel component of the controlled advancing system of the present invention.
Figure 9:
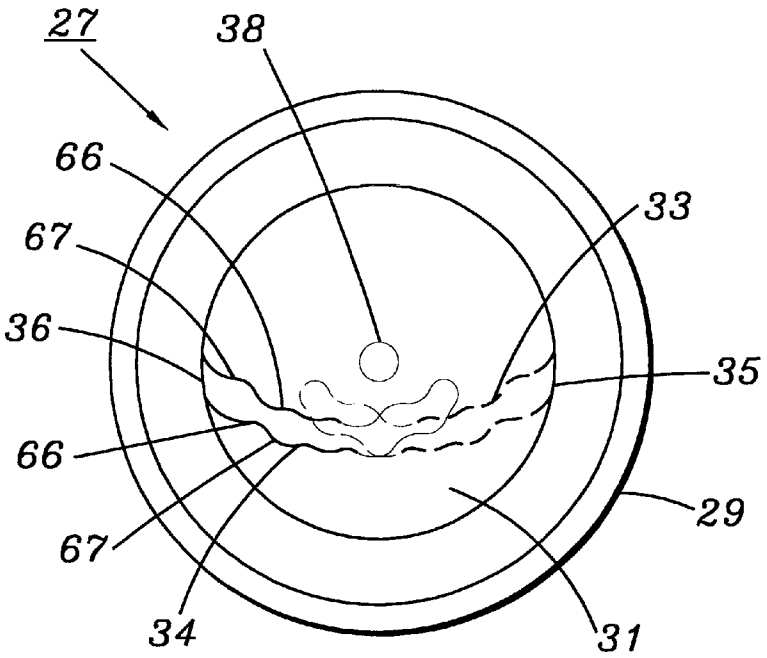
FIG. 9 is a rear side elevation view of the rotatable wheel components of FIG. 7.
Figure 8:
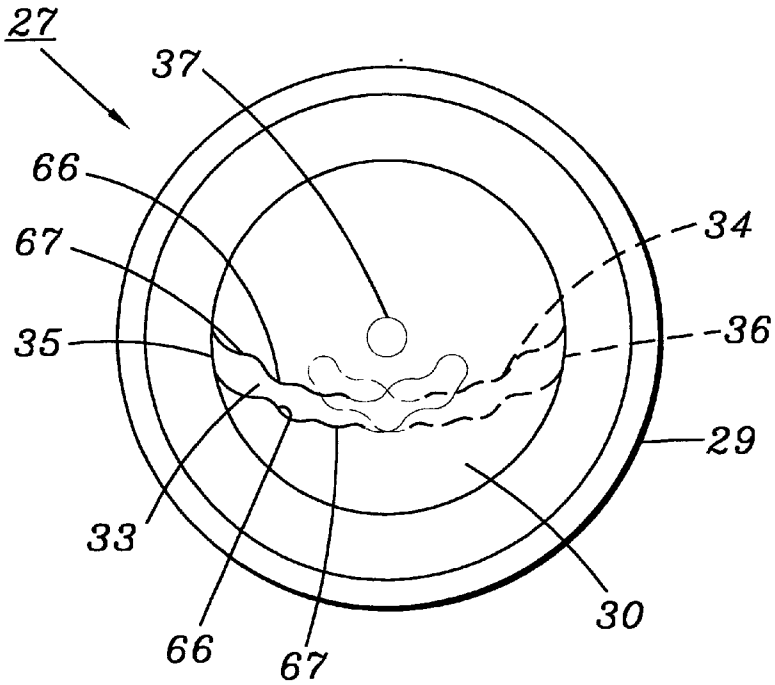
FIG. 8 is a front side view of the rotatable control wheel components of FIG. 7.

In FIGS. 4–6, the preferred construction of arm/slider 28 is clearly shown, while FIGS. 7–10 fully depict the preferred construction of wheel 27. As shown in these figures, wheel 27 comprises a circular shaped body 29 which incorporates a circular shaped raised panel 30, forming the front wall of wheel 27, and a circular-shaped raised panel 31 forming the rear surface of wheel 27. In addition, the diameter of panels 30 and 31 are smaller than the diameter of body 29.

Furthermore, raised panel 30 comprises an arcuate shaped cam slot 33 formed therein which incorporates a generally serpentine surface. Similarly, panel 31 incorporates cam slot 34 which also comprises serpentine surfaces. In the preferred construction, serpentine-shaped cam slots 33 and 34 each comprise a plurality of peaks 66 and valleys 67 forming the serpentine shape. As is more fully detailed below, this configuration assists in providing a positive stop or holding position for each of the alternate positions in which arm/slider 28 is movable.

As depicted, cam slots 33 and 34 both comprise generally radial slots, extending from the outer edge of each panel towards the center of wheel 27. As shown, cam slot 33 comprises an entry zone 35 while slots 34 comprise entry zone 36. In addition, cam slot 33 and 34 are formed in their respective panels in order to position entry zones 35 and 36, at substantially identical diametrically opposed positions.

The construction of wheel 27 is completed by forming or mounting pivot posts 37 and 38 to panels 30 and 31 at the central axis thereof. As shown, post 37 is mounted to panel 30, while post 38 is mounted to panel 31. Posts 37 and 38 are coaxial and form the axis about which wheel 27 is easily pivoted.

In its preferred construction, movable arm/slider 28 comprises a generally rectangular shaped base 40 which comprises an enlarged, centrally disposed, elongated open zone 41. In addition, pin members 42 and 43 are formed on base 40, extending from base 40 into open zone 41, in spaced apart, cooperating relationship to each other.

Furthermore, base 40 of arm/slider 28 comprises rails 44 and 45 extending outwardly from opposed side edges of base 40. Rails 44 and 45 cooperate with housing 23 of beard/mustache trimmer 20 to control the longitudinal movement of arm/slider 28 in housing 23.

In completing the preferred construction, arm/slider 28 also comprises two, juxtaposed, spaced, cooperating fingers 46 and 47, longitudinally extending from the front edge of body 40. Fingers 46 and 47 each comprise a comb engaging boss 48 formed thereon and positioned for secure engagement with the movable comb 22 of trimmer 20.

By employing this construction, rotation of wheel 27 causes arm/slider 28 to move in housing 23. This longitudinal movement directly controls the movement of comb 22, due to the direct engagement with arm/slider 28. As a result, the user is able to attain the desired movement of comb 22 in an easily employed, controlled manner.

By referring to FIGS. 2, 3 and 11A–11D, the assembled construction and operation of controlled advancing system 21 of this invention can best be understood. As depicted and detailed above, wheel 27 is rotationally mounted to support plate 26, with pins 42 and 43 of arm/slider 28 positioned for controlled engagement in cam slots 33 and 34 of wheel 27. In the preferred construction, support plate 26 is securely mounted in housing 23, peripherally surrounding and holding motor 53. However, numerous other constructions can be employed while still being within the scope of this invention.

By properly positioning pins 42 and 43, the sequential, cooperating engagement of one pin in one cam slot is provided, with the second pin being engaged in the second cam slot whenever the first pin leaves its engagement with the first slot. In this way, maximum longitudinal movement of arm/slider 28 is attained.

By employing this construction, the rotation of wheel 27 causes cam slots 33 and 34 to rotate therewith. Whenever a pin is in cam slot 33 or 34, the rotational movement of the cam slot with wheel 27 causes the pin to move in the cam slot, resulting in the longitudinal movement of arm/slider 28 relative thereto. In addition, since cam slots 33 and 34 preferably comprise serpentine surfaces, abutment stops are provided for securely maintaining arm/slider 28 in each of its plurality of positions. This abutment stop is provided by the entry of the pin member in one of the valleys 67, and the resistance to movement provided by adjacent peaks 66.

By referring to FIGS. 11A–11D, along with the following detailed disclosure, the controlled movement of arm/slider 28 relative to rotatable wheel 27 can best be understood. As is evident from this detailed disclosure, the unique construction and operation of these components provides the user with complete, trouble-free movement of comb member 22 relative to housing 23 in a manner which requires a minimum number of components and is achieved with a relatively easy assembly effort.

Figure 11A:
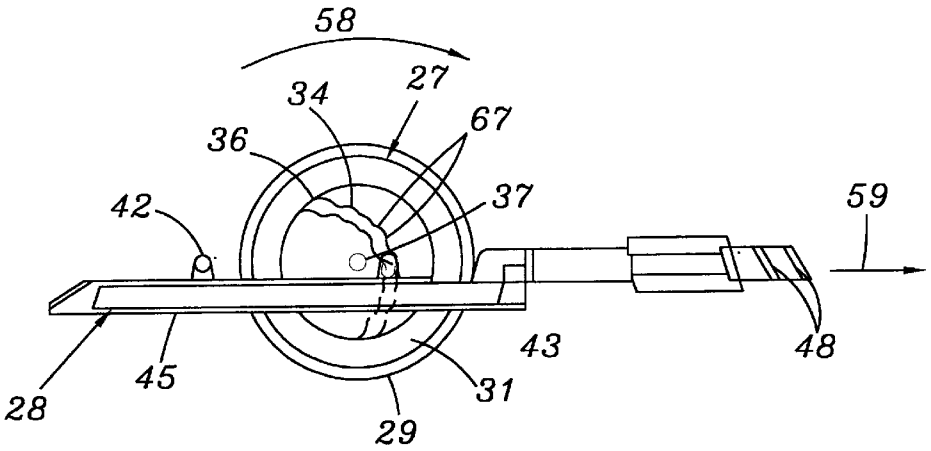
FIGS. 11A–11D are side elevation views of the rotatable wheel component assembled with the arm/slider component diagrammatically depicting a plurality of alternate positions of the slider relative to the wheel.

In FIG. 11A, the fully retracted position of arm/slider 28 is shown. In this position, comb member 22 is maintained directly adjacent cutting blades 51 and 52, as depicted in FIGS. 1 and 2. As shown in FIG. 11A, in this position, pin 43 of arm/slider 28 is mounted at the inside terminating end of arcuate cam slot 34 of rotatable wheel 27.

Whenever the user desires to advance comb member 22 forwardly relative to housing 23, causing the distance between comb member 22 and cutting blades 51 and 52 to be increased, rotatable wheel 27 is arcuately moved in the direction of arrow 58. As wheel 27 rotates in the direction of arrow 58, pin 43 is forced to move forwardly in cam slot 34, alternately stopping in each valley 67 formed in serpentine-shaped cam slot 34.

Each valley 67 represents an alternate position in which comb member 22 is positionable for establishing a plurality of alternate distances between fingers 55 and cutting blades 51 and 52. As depicted, the rotation of wheel 27 in the direction of arrow 58 causes arm/slider 28 to move longitudinally, in the direction of arrow 59.

Figure 11B:
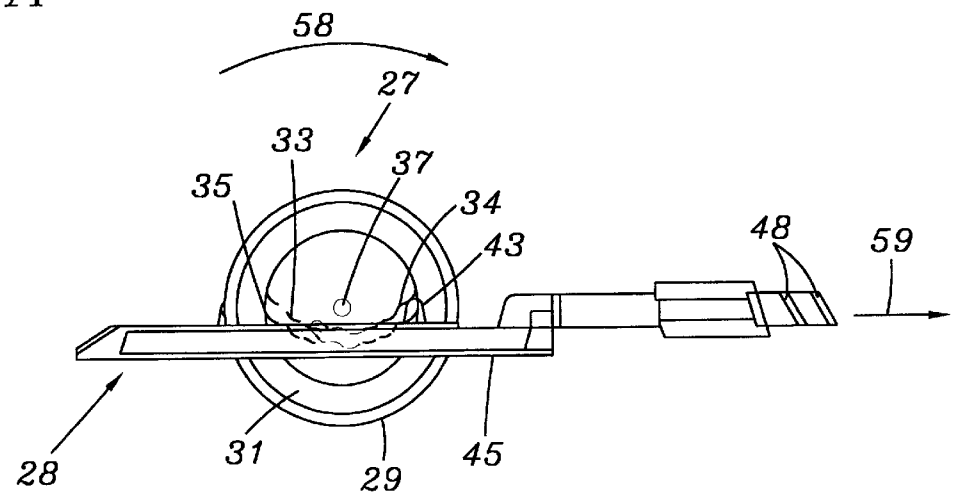

In FIG. 11B, wheel 27 is depicted arcuately rotated about 90°, with arm/slider 28 longitudinally advanced in the direction of arrow 59 about one-half of its entire travel distance. In this position, pin 43 is positioned adjacent entry zone 36 of cam slot 34, ready to exit cam slot 34. Whenever the user desires to continue to increase the spaced distance between fingers 55 of comb member 22 and cutting blades 51 and 52, the user continues to arcuately rotate wheel 27 in the direction of arrow 58.

Figure 11C:
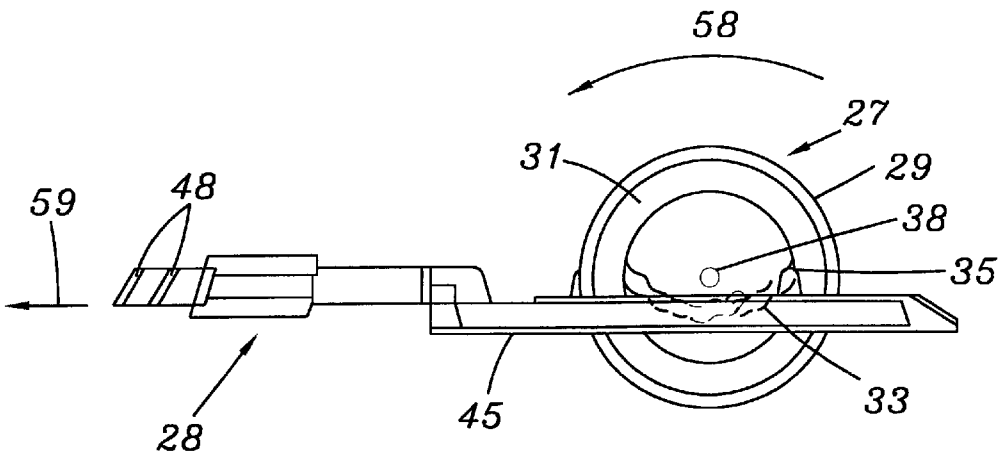

As the rotation of the wheel 27 continues, pin 43 exits entry zone 36 of cam slot 34 substantially simultaneously with the entry of pin 42 in entry zone 35 of cam slot 33. In FIG. 11C, the entry of pin 42 into entry zone 35 of cam slot 33 is shown.

Figure 11D:
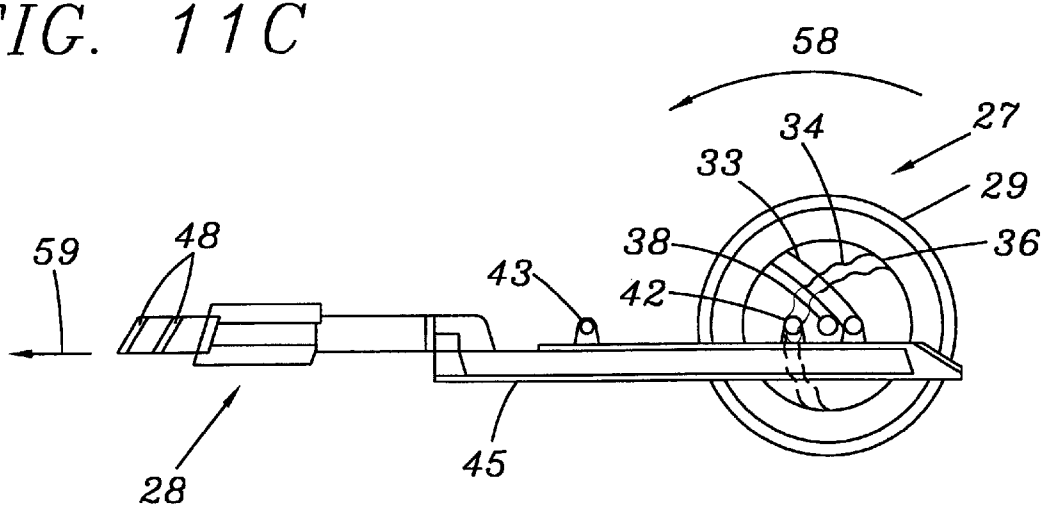

If additional spaced distance is desired, wheel 27 is rotated further in the direction of arrow 58, causing arm/slider 28 to continue to move in the direction of arrow 59. As the rotation of wheel 27 continues, cam slot 33 is rotated, forcing pin 42 to advance along the arcuate length of cam slot 33 until pin 42 reaches the terminating end of cam slot 33, as depicted in FIG. 11D. In this position, arm/slider 28 is moved forwardly to its furthest-most position, placing comb member 22 forward of cutting blades 51 and 52 to its maximum extent.

As detailed above, cam slot 33 incorporates a plurality of peaks 66 and valleys 67, with each valley 67 representing an alternate position for arm/slider 28. As wheel 27 is arcuately rotated, each valley 67 represents an alternate position within which arm/slider 28 is positionable for the user's convenience.

By employing this construction, comb member 22 automatically resists any movement regardless of the position in which comb member 22 has been placed. In this regard, since pin members 42 and 43 are positioned in a valley 67 which is surrounded by peaks 66 on both sides thereof, forced movement of comb member 22 due to pressure being applied to finger members 55 is resisted, since pins 42 and 43 are securely retained in any particular position, due to the configuration of peaks 66 and valleys 67. As a result, trouble-free, slip free operation of comb member 22 is obtained and the consumer is assured that any selected hair length which the consumer desires to attain will be achieved, without unwanted slippage or movement of comb member 22.

Finally, as shown in FIG. 3, raised panel 31 of wheel 27 comprises a plurality of grooves 60 formed on its outer surfaces. In addition, spring member 61 (shown in FIG. 3) is mounted in association with wheel 27 in a manner which causes arm 62 of spring member 61 to advance into engagement with each groove 60 as wheel 27 is rotated. In this way, a positive stop force is provided for each position of comb 22, as well as an audible click, if desired. Furthermore, the engagement of arm 62 in groove 60 provides additional resistance to movement, thereby providing further assurance that comb 22 is secured in each desired alternate position.

Furthermore, in the preferred construction, wheel 27 also incorporates indicia, such as numbers formed in raised panel 30. Each numeral represents an alternate position for comb member 22 and is positioned for being displayed through cut-out window 63, shown in FIG. 1. In this way, ease of reference and selection of a particular desired comb member position is easily attained.

It will thus be seen that the object set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

We claim:

1. A movement controlling system for enabling the movement of a comb member of a hair trimmer to be controlled relative to the cutting blades thereof, said movement controlling system comprising:

A. a slider adopted to be movably mounted in the hair trimmer and comprising a. at least one pin member formed thereon and positioned for cooperative engagement with a cam slot, and b. at least one comb engaging member mounted to the slider and positioned for cooperating engagement with the comb member of the hair trimmer for controllably moving the comb member relative to the hair trimmer in response to movement of the slider; and B. a wheel member rotationally mounted to the hair trimmer and comprising at least one cam slot positioned for cooperative engagement with the pin member of the slider for controllably moving the pin member and the slider along a longitudinal path in response to rotational movement of the wheel member, whereby the movement of the slider and the comb member into any desired position is quickly and easily attained by merely rotating the wheel member.

2. The movement controlling system defined in claim 1, wherein said cam slot is further defined as comprising an elongated, arcuate shape.

3. The movement controlling system defined in claim 2, wherein said arcuate cam slot is further defined as having a serpentine configuration.

4. The movement controlling system defined in claim 2, wherein said cam slot is further defined as comprising a plurality of peaks and valleys formed along at least one surface thereof, defining a plurality of alternate positions for the slider and comb member while also cooperating with the pin member to provide resistance to movement between each of said alternate positions.

5. The movement controlling system defined in claim 2, wherein said slider is further defined as comprising two separate and independent pin members formed thereon, with each of said pin members being on opposite sides of said slider and said wheel member is further defined as comprising two cam slots formed therein, with each of said cam slots being on opposite surfaces of the wheel member.

6. The movement controlling system defined in claim 5, wherein said wheel member is further defined as comprising two raised panels, with each of said panels being formed on opposite surfaces of the wheel member, and said two cam slots are further defined as being formed in said raised panels of the wheel member.

7. The movement controlling system defined in claim 6, wherein said cam slots are further defined as comprising elongated arcuate shapes extending generally radially along each of said panels and cooperatively positioned with each other to extend substantially the entire diameter of said panels.

8. The movement controlling system defined in claim 7, wherein said wheel member further comprises a plurality of recesses formed in an outer edge of one of said raised panels and said hair trimmer comprises a spring biased arm mounted thereto and positioned for cooperative engagement with the recesses formed in the wheel member for providing an audible designation of each position of the comb member relative to the hair trimmer while also providing additional resistance to movement between said alternate positions.

9. The movement controlling system defined in claim 7, wherein said slider is further defined as comprising a generally rectangular shaped frame structure with two juxtaposed, spaced, facing rails forming a portion thereof, and with the pin members mounted to said facing rails in juxtaposed cooperating relationship with each other.

10. The movement controlling system defined in claim 9, wherein the slider further comprises a pair of finger members extending forwardly from the frame structure in juxtaposed, spaced, cooperating relationship with each other, with each of said finger members incorporating a comb engaging member position for controlled engagement with the comb member for causing the comb member to move between its alternate positions.

11. An adjustable hair trimmer incorporating a movable comb member for controlling the length of hair being cut, said trimmer comprising:

A a housing;

B a pair of cutting blades mounted in the housing and cooperatively associated with each other for providing the desired hair cutting movement;

C a comb member moveably mounted to the housing in cooperative alignment with the cutting blades for defining a plurality of alternate positions wherein the surface of the comb member is positioned at selected spaced distances relative to the cutting blades;

D a slider movably mounted to the housing and comprising a at least one pin member formed thereon and positioned for cooperative engagement with a cam slot, and b at least one comb engaging member mounted to the slider and positioned for cooperating engagement with the comb member for controllably moving the comb member relative to the housing of the hair trimmer in response to movement of the slider; and E a wheel member rotationally mounted in the housing of the hair trimmer and comprising at least one cam slot positioned for cooperative engagement with the pin member of the slider for controllably moving the pin member and the slider along a longitudinal path in response to rotational movement of the wheel member, whereby the rotational movement of the wheel member causes the slider and the comb member to be moved into any desired position quickly and easily.

12. The hair trimmer defined in claim 11, wherein said cam slot is further defined as comprising an elongated, arcuate shape.

13. The hair trimmer defined in claim 12, wherein said arcuate cam slot is further defined as having a serpentine configuration.

14. The hair trimmer defined in claim 12, wherein said cam slot is further defined as comprising a plurality of peaks and valleys formed along at least one surface thereof, defining a plurality of alternate positions for the slider and comb member while also cooperating with the pin member to provide resistance to movement between each of said alternate positions.

15. The hair trimmer defined in claim 12, wherein said slider is further defined as comprising two separate and independent pin members formed thereon, with each of said pin members being on opposite sides of said slider and said wheel member is further defined as comprising two cam slots formed therein, with each of said cam slots being on opposite surfaces of the wheel member.

16. The hair trimmer defined in claim 15, wherein said wheel member is further defined as comprising two raised panels, with each of said panels being formed on opposite surfaces of the wheel member, and said two cam slots are further defined as being formed in said raised panels of the wheel member.

17. The hair trimmer defined in claim 16, wherein said cam slots are further defined as comprising elongated arcuate shapes extending generally radially along each of said panels and cooperatively positioned with each other to extend substantially the entire diameter of said panels.

18. The hair trimmer defined in claim 17, wherein said wheel member further comprises a plurality of recesses formed in an outer edge of one of said raised panels and said hair trimmer comprises a spring biased arm mounted to the housing and positioned for cooperative engagement with the recesses formed in the wheel member for providing an audible designation of each position of the comb member relative to the hair trimmer while also providing additional resistance to movement between said alternate positions.

19. The hair trimmer defined in claim 17, wherein said slider is further defined as comprising a generally rectangular shaped frame structure with two juxtaposed, spaced, facing rails forming a portion thereof, and with the pin members mounted to said facing rails in juxtaposed cooperating relationship with each other.

20. The hair trimmer defined in claim 19, wherein the slider further comprises a pair of finger members extending forwardly from the frame structure in juxtaposed, spaced, cooperating relationship with each other, with each of said finger members incorporating a comb engaging member position for controlled engagement with the comb member for causing the comb member to move between its alternate positions.

* * * * *